US007001147B1

(12) United States Patent
Phillips et al.

(10) Patent No.: US 7,001,147 B1
(45) Date of Patent: Feb. 21, 2006

(54) AIRFOIL SHAPE AND SIDEWALL FLOWPATH SURFACES FOR A TURBINE NOZZLE

(75) Inventors: James Stewart Phillips, Easley, SC (US); Raymond Allan Wedlake, Greenville, SC (US); Randall Douglas Gill, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/900,200

(22) Filed: Jul. 28, 2004

(51) Int. Cl.
*F01D 9/04* (2006.01)

(52) U.S. Cl. ..... 415/191; 415/193; 415/210.1

(58) Field of Classification Search ..... 415/191, 415/193, 208.1, 208.2, 209.1, 210.1, 211.2; 416/223 R, 223 A, 243, DIG. 2
See application file for complete search history.

(56) References Cited

U.S. PATENT DOCUMENTS

| | | | | |
|---|---|---|---|---|
| 6,398,489 | B1 | 6/2002 | Burdgick et al. | |
| 6,461,109 | B1 * | 10/2002 | Wedlake et al. | 416/223 R |
| 6,503,054 | B1 * | 1/2003 | Bielek et al. | 415/191 |
| 6,722,853 | B1 * | 4/2004 | Humanchuk et al. | 416/223 A |
| 6,736,599 | B1 * | 5/2004 | Jacks et al. | 415/191 |
| 6,866,477 | B1 * | 3/2005 | Arness et al. | 415/191 |
| 6,887,041 | B1 * | 5/2005 | Coke et al. | 415/191 |

* cited by examiner

*Primary Examiner*—Christopher Verdier
(74) *Attorney, Agent, or Firm*—Nixon & Vanderhye P.C.

(57) ABSTRACT

A turbine nozzle includes airfoil and sidewall surfaces. The airfoil and sidewall surfaces have profiles substantially in accordance with Cartesian coordinate values of X, Y and Z set forth in Tables I–IV for the pressure and suction sides of the airfoil, and the outer and inner sidewall surfaces, respectively. The X, Y and Z values are distances in inches. The X and Y values for the airfoil, when connected by smooth continuing arcs, define airfoil profile sections at each distance Z. The profile sections at the Z distances are joined smoothly with one another to form a complete airfoil shape. The X, Y and Z values of Tables III and IV define the outer and inner sidewall surfaces, respectively, of the gas flowpath.

26 Claims, 4 Drawing Sheets

AIRFOIL SHAPE AND SIDEWALL FLOWPATH SURFACES FOR A TURBINE NOZZLE

BACKGROUND OF THE INVENTION

The present invention relates to a nozzle stage of a gas turbine and particularly relates to a first stage nozzle airfoil profile and sidewall flowpath surfaces.

In the development of an advanced gas turbine, many specific requirements must be met for each stage of the hot gas path section of the turbine in order to meet design goals. Particularly, and in addition to other goals, the first stage of the turbine must meet efficiency, heat load, life, throat area and vectoring requirements to meet those goals. Conventional nozzle designs do not allow for the added benefit of advanced three-dimensional aerodynamics that improve the use of the combustion gases to improve blade loading sufficiently to meet that goal.

BRIEF DESCRIPTION OF THE INVENTION

In accordance with the preferred embodiment of the present invention, there is provided unique nozzle flowpath surfaces, specifically an airfoil suction-side surface, an airfoil pressure side surface, an inner sidewall surface and an outer sidewall surface for the nozzle of a turbine stage, preferably the first stage of a gas turbine. Each nozzle flowpath surface is defined by a unique loci of points to achieve the necessary efficiency whereby improved turbine performance is obtained. The suction-side and pressure-side surfaces join smoothly at the airfoil leading and trailing edges.

In accordance with a preferred embodiment of the present invention, there is provided a turbine nozzle having a pressure side airfoil surface, the pressure side airfoil surface having a nominal profile substantially in accordance with Cartesian coordinate values of X, Y and Z set forth in inches in Table I, wherein the Z values are drop dimensions from a reference point origin on an outside diameter flowpath along a nozzle airfoil stacking axis perpendicular to a centerline axis of rotation of the turbine; and wherein the X and Y values, when connected by smooth continuing arcs, define pressure side airfoil surface profile sections at each distance Z from the origin, the profile sections at the Z distances being joined smoothly with one another to form a pressure side airfoil surface shape.

In accordance with a further embodiment of the present invention, there is provided a turbine nozzle having a suction side airfoil surface, the suction side airfoil surface having a nominal profile substantially in accordance with Cartesian coordinate values of X, Y and Z set forth in inches in Table II, wherein the Z values are drop dimensions from a reference point origin on an outside diameter flowpath along a nozzle airfoil stacking axis perpendicular to a centerline axis of rotation of the turbine; and wherein the X and Y values, when connected by smooth continuing arcs, define suction side airfoil surface profile sections at each distance Z from the origin, the profile sections at the Z distances being joined smoothly with one another to form a suction side airfoil surface shape.

In accordance with a further embodiment of the present invention, there is provided a turbine nozzle having an outer sidewall surface, the outer sidewall surface having a nominal profile substantially in accordance with Cartesian coordinate values of X, Y and Z set forth in inches in Table III, wherein the Z values are drop dimensions from a reference point origin on an outside diameter flowpath along a nozzle airfoil stacking axis perpendicular to a centerline axis of rotation of the turbine; and wherein the X and Y values, when connected by smooth continuing arcs at each distance Z, define an outer sidewall surface shape.

In accordance with a further embodiment of the present invention, there is provided a turbine nozzle having an inner sidewall surface, the inner sidewall surface having a nominal profile substantially in accordance with Cartesian coordinate values of X, Y and Z set forth in inches in Table IV, wherein the Z values are drop dimensions from a reference point origin on an outside diameter flowpath along a nozzle airfoil stacking axis perpendicular to a centerline axis of rotation of the turbine; and wherein the X and Y values, when connected by smooth continuing arcs at each distance Z, define an inner sidewall surface shape.

In accordance with a further embodiment of the present invention, there is provided a turbine comprising a turbine nozzle having a plurality of airfoils having an airfoil shape, each airfoil having pressure and suction side airfoil surfaces defining a nominal airfoil profile substantially in accordance with Cartesian coordinate values of X, Y and Z set forth in Tables I and II, wherein the Z values are drop dimensions from a reference point origin on an outside diameter flowpath along a nozzle airfoil stacking axis perpendicular to a centerline axis of rotation of the turbine, and wherein the X and Y values, when connected by smooth continuing arcs, define airfoil profile sections at each distance Z, the profile sections at the Z distances being joined smoothly with one another to form an airfoil shape.

DETAILED DESCRIPTION OF THE INVENTION

Figure 1:
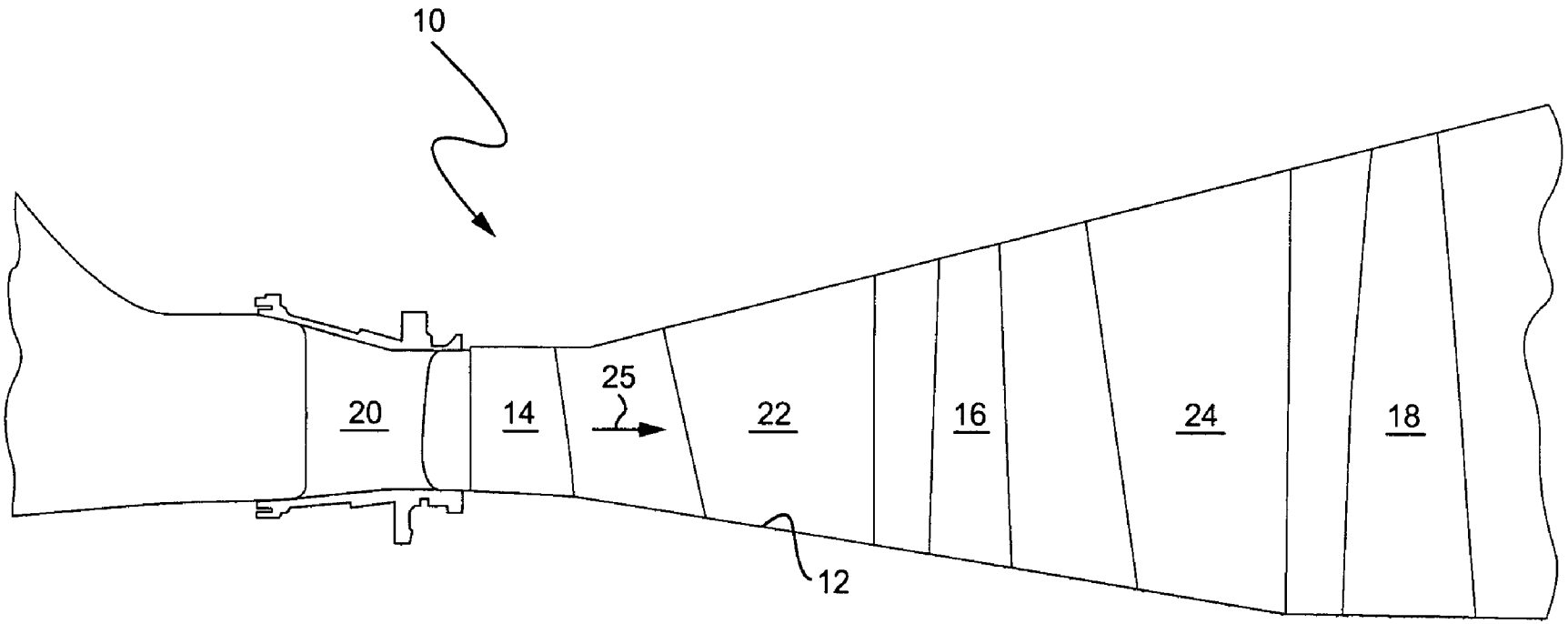
FIG. 1 is a schematic illustration of a turbine having a first stage turbine nozzle employing the airfoil and nozzle wall surfaces according to a preferred aspect of the present invention.

Referring now to FIG. 1, there is illustrated a portion of a turbine generally designated 10. Turbine 10 includes a rotor 12 mounting first, second and third stage buckets 14, 16 and 18 respectively. Stator vanes 20, 22 and 24 also form part of the respective first, second and third stages of the turbine. It will be appreciated that a three-stage turbine is accordingly illustrated having a gas flow path indicated by the arrow 25 in FIG. 1.

Figure 2:
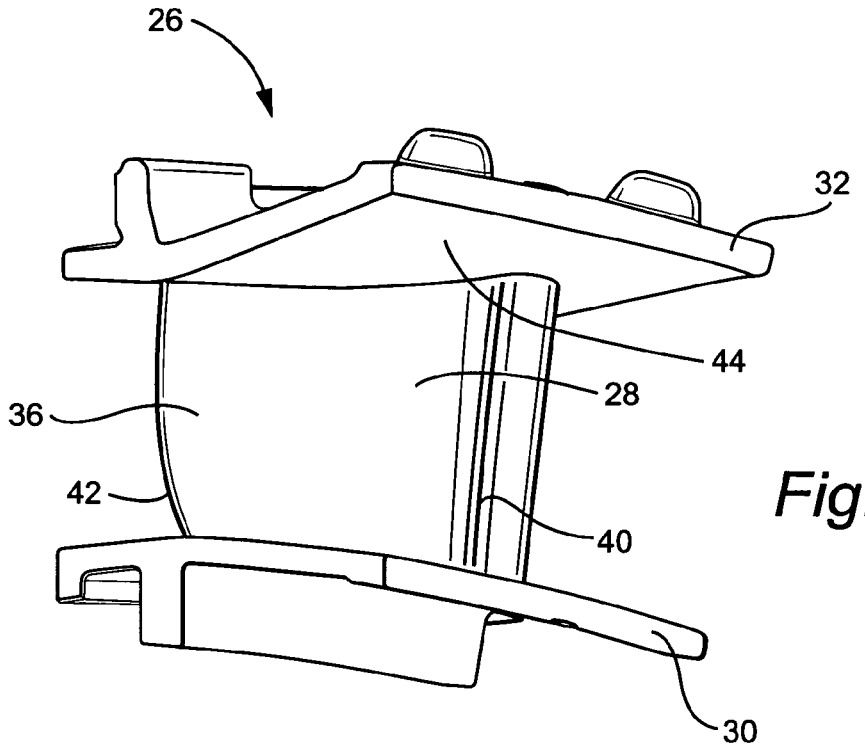
FIG. 2 is a frontal leading edge perspective view of a nozzle stage segment illustrating an airfoil pressure side surface, portions of the airfoil suction side surface, and portions of inner and outer wall surfaces in accordance with a preferred aspect of the present invention.
Figure 3:
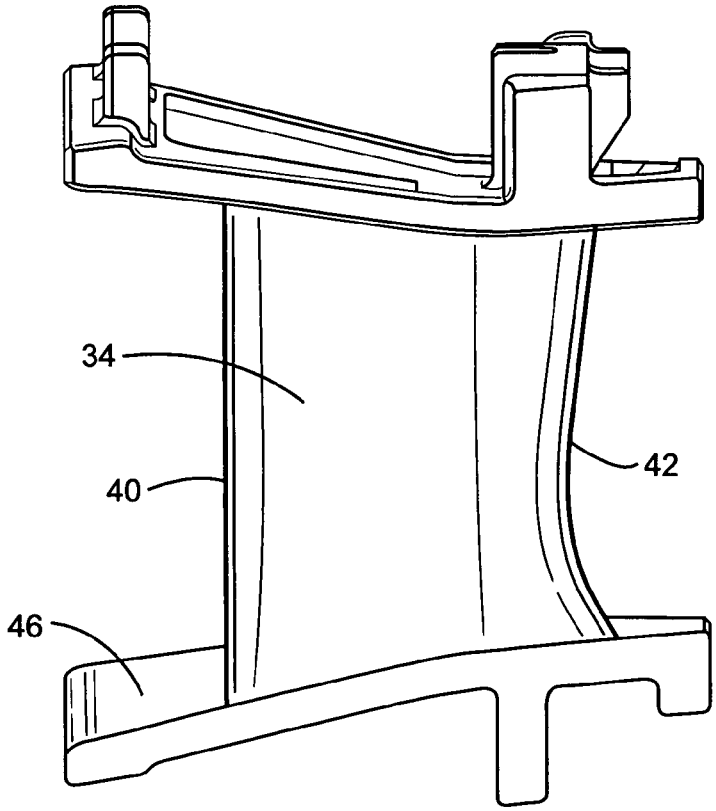
FIG. 3 is a suction side view of the first stage nozzle airfoil and wall surfaces.
Figure 4:
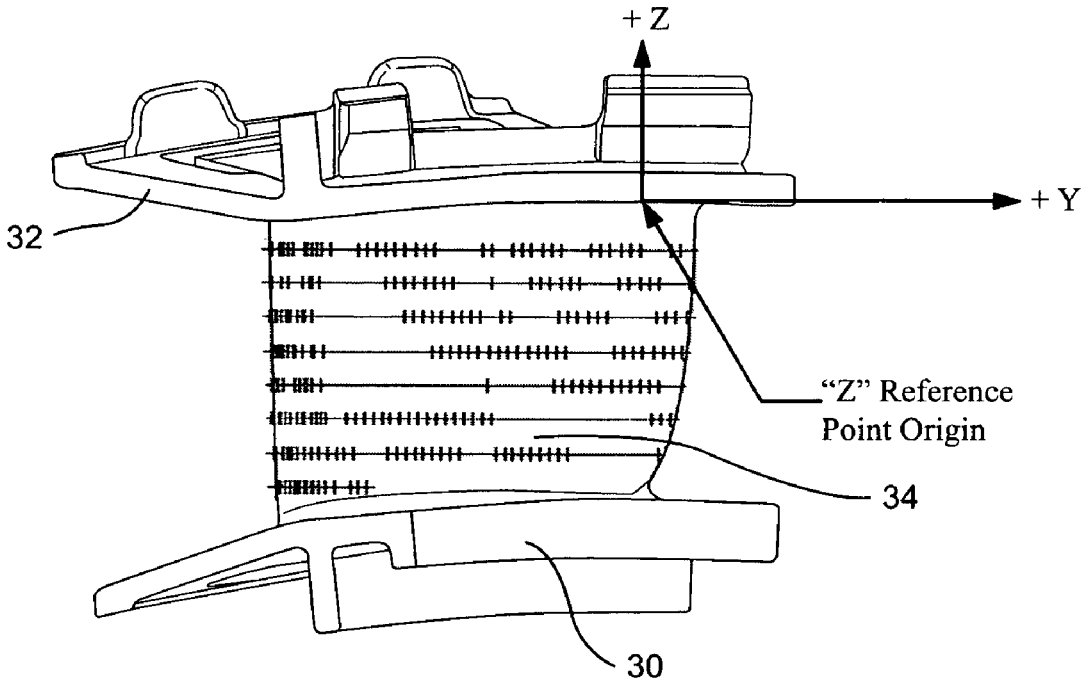
FIG. 4 is an aft view of the first stage turbine nozzle illustrating point distributions on the airfoil suction wall surfaces.
Figure 5:
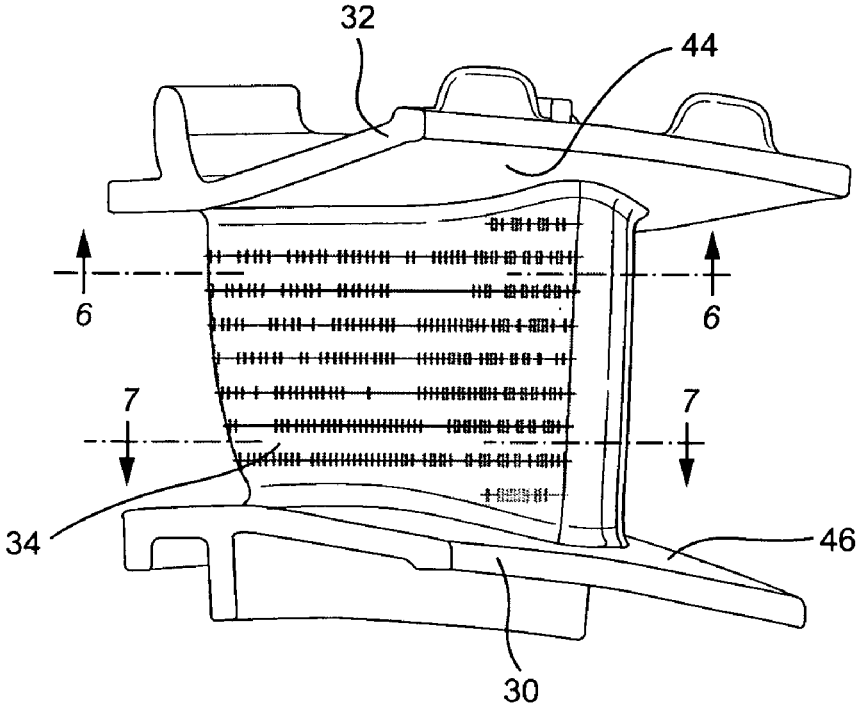
FIG. 5 is a frontal view of the first stage turbine nozzle illustrating point distributions on the airfoil suction side.
Figure 6:
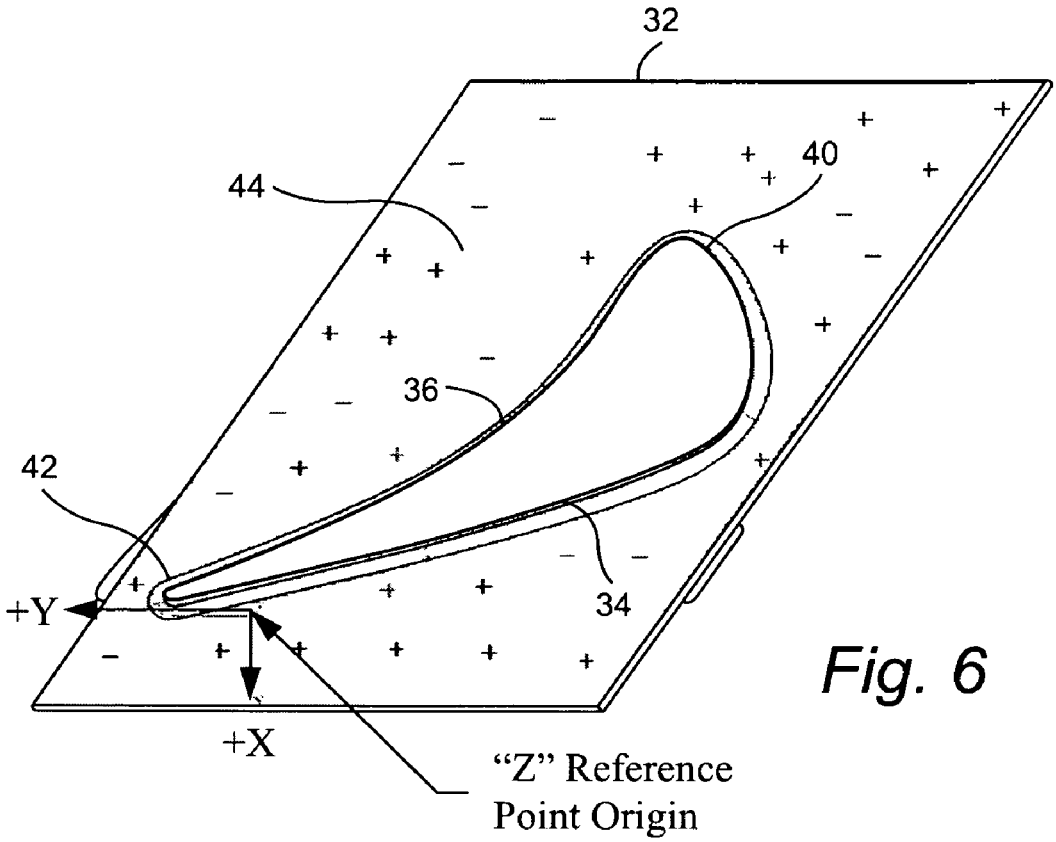
FIG. 6 is a view looking along a Z axis and taken generally about on line 6—6 in FIG. 5 illustrating the outer sidewall flowpath surface and airfoil profile.
Figure 7:
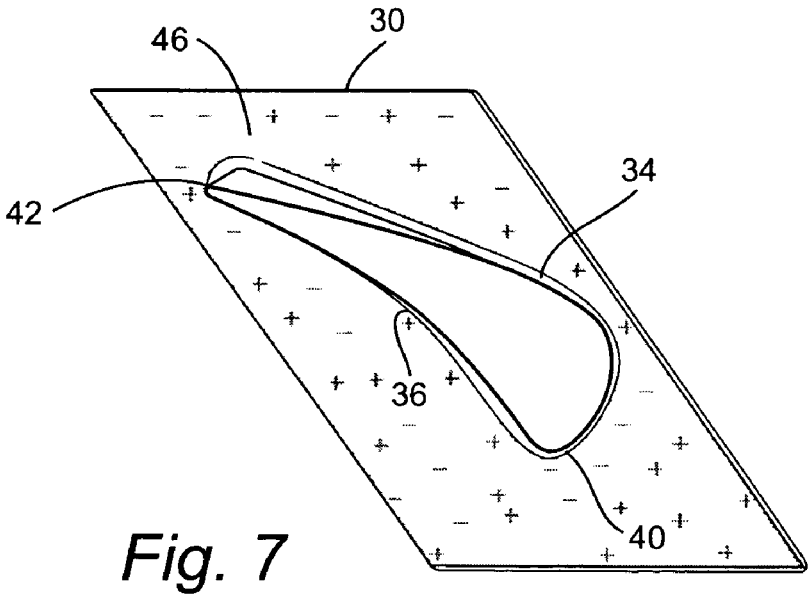
FIG. 7 is a view looking along the Z axis and taken generally about on line 7—7 in FIG. 5 illustrating the inner sidewall flowpath surface and airfoil profile.

Referring to FIGS. 2–4, there is illustrated a nozzle stage segment generally designated 26 mounting an airfoil or vane 28 extending between inner and outer platforms or sidewalls 30 and 32 respectively. The nozzle segment 26 comprises one of a plurality of segments forming the first stage nozzle 20 and which segments 26 are disposed in a circumferential array thereof in the annular gas flow path 25. It will also be appreciated that each nozzle segment 26 may include one, two or more nozzle airfoils, e.g. vanes 28, extending between the sidewalls 30 and 32 respectively. In the specific first stage nozzle arrangement illustrated, there is preferably a single nozzle vane 28 per segment. Also, there are preferably forty nozzle segments and hence forty nozzle vanes or airfoils in the first stage nozzle 20. The airfoil 28 has a profile including a three-dimensional compound curvature with pressure and suction sidewalls 36 and 34, respectively, illustrated in FIGS. 2 and 3 as well as respective leading and trailing edges 40 and 42. The outer and inner sidewalls 44 and 46, respectively, are conical surfaces which define radial flowpath surfaces containing the gaspath flow in a radial direction.

A Cartesian coordinate system of X, Y and Z values are given in Tables I–II below and define the nominal profile of the respective pressure and suction sidewall surfaces of the nozzle airfoil 28. Similar X, Y and Z coordinate values for the respective outer and inner sidewall surfaces 44 and 46 are given in Tables III and IV. The coordinate values for the X, Y and Z coordinates are set forth in inches in Tables I–IV although other units of dimensions may be used. The Z values set forth in the Tables are drop dimensions from a point on the flowpath along the nozzle airfoil stacking axis (a specific axis or line perpendicular to engine rotation centerline). The Cartesian coordinate system has orthogonally-related X, Y and Z axes with the Z axis extending perpendicular to a plane normal to a plane containing the X and Y values. By defining X and Y coordinate values at selected locations in a Z direction normal to the X, Y plane, the profile of the surfaces can be ascertained. By connecting the X and Y values for the airfoil with smooth continuing arcs, each airfoil profile section at each distance Z is fixed. The airfoil surface profiles of the various surface locations between the distances Z are determined by smoothly connecting the adjacent profile sections to one another to form airfoil surfaces. Similarly, the X, Y and Z coordinate values for the inner and outer sidewalls define a series of points which may be connected to one another by smooth continuous arcs which, when filled in with continuous surfaces areas, define the shape or profile of the inner and outer sidewall surfaces in part defining the flowpath. These values represent the nozzle flowpath surface profiles at ambient, non-operating or non-hot conditions and are for the coated finished nozzle flowpath. The sign convention is illustrated in FIG. 4 and is as typically used in Cartesian coordinate systems.

The Cartesian coordinate values in Tables I–IV are generated and shown to three decimal places for determining the profile of the nozzle flowpath surfaces. There are typical manufacturing tolerances as well as coating thickness tolerances, which must be accounted for with the actual flowpath surfaces. Accordingly, the values for the profiles given in Tables I–IV are for nominal flowpath surfaces. Accordingly, a distance of ±0.105 inches in a direction normal to any surface location along the flowpath profile defines the flowpath surface envelopes for this particular nozzle flowpath design and turbine.

The coordinate values given in Table I below define the preferred nominal profile of the pressure sidewall surface 36 of airfoil 28:

TABLE I

Airfoil pressure-side defining points:

| X | Y | Z | X | Y | Z | X | Y | Z |
|---|---|---|---|---|---|---|---|---|
| −5.243 | −5.8327 | −0.2796 | −4.3988 | −5.2585 | −0.2796 | −5.5243 | −6.0241 | −0.2796 |
| −3.8674 | −4.8335 | −0.2796 | −4.5371 | −5.3578 | −0.2796 | −5.66 | −6.1268 | −0.2796 |
| −5.3845 | −5.9271 | −0.2796 | −4.6768 | −5.4549 | −0.2796 | −5.7875 | −6.2394 | −0.2796 |
| −3.9967 | −4.9442 | −0.2796 | −4.8176 | −5.5504 | −0.2796 | −6.0431 | −6.672 | −0.2796 |
| −4.1285 | −5.0519 | −0.2796 | −4.9591 | −5.6449 | −0.2796 | −5.9006 | −6.3663 | −0.2796 |
| −4.2626 | −5.1566 | −0.2796 | −5.1011 | −5.7388 | −0.2796 | −5.9898 | −6.5109 | −0.2796 |
| −0.6347 | 0.8326 | −1.0296 | −2.0724 | −2.4037 | −1.0296 | −5.5268 | −6.0008 | −1.0296 |
| −0.4521 | 1.3048 | −1.0296 | −3.0748 | −3.963 | −1.0296 | −4.1402 | −5.0404 | −1.0296 |
| −0.5124 | 1.1472 | −1.0296 | −2.1531 | −2.5519 | −1.0296 | −5.6616 | −6.1023 | −1.0296 |
| −0.5735 | 0.9899 | −1.0296 | −3.1809 | −4.0942 | −1.0296 | −4.2732 | −5.1443 | −1.0296 |
| −1.2729 | −0.7293 | −1.0296 | −2.2357 | −2.699 | −1.0296 | −5.7884 | −6.2135 | −1.0296 |
| −1.3402 | −0.884 | −1.0296 | −3.29 | −4.2229 | −1.0296 | −4.4084 | −5.2452 | −1.0296 |
| −0.6963 | 0.6756 | −1.0296 | −2.32 | −2.8452 | −1.0296 | −4.5455 | −5.3436 | −1.0296 |
| −1.4085 | −1.0383 | −1.0296 | −3.4022 | −4.349 | −1.0296 | −4.6841 | −5.4398 | −1.0296 |
| −0.7583 | 0.5186 | −1.0296 | −2.4063 | −2.9902 | −1.0296 | −4.8239 | −5.5344 | −1.0296 |
| −1.4776 | −1.1922 | −1.0296 | −3.5174 | −4.4722 | −1.0296 | −5.3878 | −5.9051 | −1.0296 |
| −0.8208 | 0.3619 | −1.0296 | −2.4947 | −3.1339 | −1.0296 | −4.9645 | −5.6277 | −1.0296 |
| −1.5477 | −1.3457 | −1.0296 | −1.6912 | −1.6511 | −1.0296 | −3.6359 | −4.5924 | −1.0296 |
| −0.8837 | 0.2053 | −1.0296 | −2.5852 | −3.2763 | −1.0296 | −5.1056 | −5.7201 | −1.0296 |
| −1.6189 | −1.4987 | −1.0296 | −1.7648 | −1.803 | −1.0296 | −3.7575 | −4.7093 | −1.0296 |
| −0.947 | 0.0489 | −1.0296 | −2.6781 | −3.4172 | −1.0296 | −5.247 | −5.8122 | −1.0296 |
| −1.0109 | −0.1072 | −1.0296 | −1.8396 | −1.9542 | −1.0296 | −3.8822 | −4.823 | −1.0296 |
| −1.0754 | −0.2632 | −1.0296 | −2.7733 | −3.5565 | −1.0296 | −4.0098 | −4.9334 | −1.0296 |
| −1.1405 | −0.4188 | −1.0296 | −1.9157 | −2.1048 | −1.0296 | −5.9009 | −6.3391 | −1.0296 |
| −1.2063 | −0.5742 | −1.0296 | −2.8711 | −3.694 | −1.0296 | −5.9898 | −6.4822 | −1.0296 |
| −2.9715 | −3.8296 | −1.0296 | −1.9933 | −2.2547 | −1.0296 | −6.043 | −6.6417 | −1.0296 |
| −1.4872 | −1.0482 | −1.7796 | −3.2292 | −4.0732 | −1.7796 | −5.7907 | −6.1841 | −1.7796 |
| −0.8504 | 0.4924 | −1.7796 | −2.3015 | −2.6905 | −1.7796 | −4.4307 | −5.2227 | −1.7796 |
| −1.5552 | −1.2004 | −1.7796 | −3.3363 | −4.201 | −1.7796 | −4.5652 | −5.3211 | −1.7796 |
| −0.9113 | 0.3372 | −1.7796 | −2.3844 | −2.8351 | −1.7796 | −4.7014 | −5.4173 | −1.7796 |
| −1.6242 | −1.3521 | −1.7796 | −3.4463 | −4.3262 | −1.7796 | −4.8389 | −5.5115 | −1.7796 |

TABLE I-continued

| Airfoil pressure-side defining points: | | | | | | | | |
|---|---|---|---|---|---|---|---|---|
| X | Y | Z | X | Y | Z | X | Y | Z |
| −0.9726 | 0.1822 | −1.7796 | −2.4693 | −2.9786 | −1.7796 | −4.9775 | −5.6042 | −1.7796 |
| −1.6942 | −1.5034 | −1.7796 | −3.5593 | −4.4488 | −1.7796 | −3.6752 | −4.5686 | −1.7796 |
| −1.0345 | 0.0274 | −1.7796 | −2.5561 | −3.1209 | −1.7796 | −5.1169 | −5.6956 | −1.7796 |
| −1.0971 | −0.1272 | −1.7796 | −1.7654 | −1.6542 | −1.7796 | −3.7941 | −4.6854 | −1.7796 |
| −1.1602 | −0.2814 | −1.7796 | −2.645 | −3.2619 | −1.7796 | −5.2569 | −5.7862 | −1.7796 |
| −0.5532 | 1.2712 | −1.7796 | −2.7361 | −3.4016 | −1.7796 | −3.9159 | −4.7993 | −1.7796 |
| −1.224 | −0.4355 | −1.7796 | −1.9115 | −1.9539 | −1.7796 | −5.3963 | −5.8777 | −1.7796 |
| −0.6117 | 1.115 | −1.7796 | −2.8295 | −3.5396 | −1.7796 | −4.0405 | −4.91 | −1.7796 |
| −1.2886 | −0.5891 | −1.7796 | −1.9865 | −2.1028 | −1.7796 | −5.5333 | −5.9726 | −1.7796 |
| −0.6708 | 0.9592 | −1.7796 | −2.9254 | −3.676 | −1.7796 | −4.168 | −5.0175 | −1.7796 |
| −1.354 | −0.7425 | −1.7796 | −2.0629 | −2.251 | −1.7796 | −5.6658 | −6.0738 | −1.7796 |
| −0.7302 | 0.8034 | −1.7796 | −3.0239 | −3.8105 | −1.7796 | −4.2981 | −5.1216 | −1.7796 |
| −1.4201 | −0.8955 | −1.7796 | −2.1408 | −2.3984 | −1.7796 | −5.9019 | −6.3081 | −1.7796 |
| −0.7901 | 0.6478 | −1.7796 | −3.1251 | −3.943 | −1.7796 | −5.99 | −6.4493 | −1.7796 |
| −1.8378 | −1.8043 | −1.7796 | −2.2203 | −2.5449 | −1.7796 | −6.0428 | −6.6069 | −1.7796 |
| −1.0601 | 0.1418 | −2.5296 | −1.9158 | −1.8133 | −2.5296 | −2.4589 | −2.826 | −2.5296 |
| −1.7731 | −1.5175 | −2.5296 | −1.989 | −1.9603 | −2.5296 | −4.729 | −5.3848 | −2.5296 |
| −1.1208 | −0.0108 | −2.5296 | −3.5064 | −4.2941 | −2.5296 | −4.8631 | −5.4796 | −2.5296 |
| −1.1823 | −0.163 | −2.5296 | −2.5431 | −2.967 | −2.5296 | −4.9984 | −5.5726 | −2.5296 |
| −1.2445 | −0.315 | −2.5296 | −3.6169 | −4.4155 | −2.5296 | −5.1347 | −5.6642 | −2.5296 |
| −0.6518 | 1.2162 | −2.5296 | −2.6292 | −3.1068 | −2.5296 | −3.8461 | −4.6507 | −2.5296 |
| −1.3074 | −0.4667 | −2.5296 | −3.7301 | −4.5344 | −2.5296 | −5.2717 | −5.7547 | −2.5296 |
| −0.7084 | 1.0621 | −2.5296 | −2.7173 | −3.2454 | −2.5296 | −3.9647 | −4.7642 | −2.5296 |
| −1.3712 | −0.618 | −2.5296 | −2.8074 | −3.3827 | −2.5296 | −5.4083 | −5.8459 | −2.5296 |
| −0.7657 | 0.9082 | −2.5296 | −2.8998 | −3.5184 | −2.5296 | −4.086 | −4.8749 | −2.5296 |
| −1.4358 | −0.769 | −2.5296 | −2.0635 | −2.1066 | −2.5296 | −5.5426 | −5.9404 | −2.5296 |
| −0.8234 | 0.7545 | −2.5296 | −2.9945 | −3.6526 | −2.5296 | −4.21 | −4.9825 | −2.5296 |
| −1.5013 | −0.9196 | −2.5296 | −2.1395 | −2.2522 | −2.5296 | −5.6723 | −6.0411 | −2.5296 |
| −0.8817 | 0.601 | −2.5296 | −3.0916 | −3.785 | −2.5296 | −4.3366 | −5.0871 | −2.5296 |
| −1.5677 | −1.0697 | −2.5296 | −2.2169 | −2.397 | −2.5296 | −5.7946 | −6.1505 | −2.5296 |
| −0.9405 | 0.4477 | −2.5296 | −3.1913 | −3.9155 | −2.5296 | −4.4655 | −5.1888 | −2.5296 |
| −1.6351 | −1.2195 | −2.5296 | −2.2959 | −2.5409 | −2.5296 | −5.9037 | −6.2731 | −2.5296 |
| −1 | 0.2946 | −2.5296 | −3.2936 | −4.0439 | −2.5296 | −4.5964 | −5.288 | −2.5296 |
| −1.7036 | −1.3687 | −2.5296 | −2.3765 | −2.684 | −2.5296 | −5.9904 | −6.4122 | −2.5296 |
| −1.8439 | −1.6657 | −2.5296 | −3.3986 | −4.1702 | −2.5296 | −6.0425 | −6.5674 | −2.5296 |
| −1.2538 | −0.2173 | −3.2796 | −2.7874 | −3.2369 | −3.2796 | −1.9131 | −1.6915 | −3.2796 |
| −1.3156 | −0.3665 | −3.2796 | −1.985 | −1.8361 | −3.2796 | −5.0227 | −5.5391 | −3.2796 |
| −0.731 | 1.139 | −3.2796 | −2.8773 | −3.3711 | −3.2796 | −5.1553 | −5.6313 | −3.2796 |
| −1.3782 | −0.5154 | −3.2796 | −2.0583 | −1.9801 | −3.2796 | −3.9016 | −4.6166 | −3.2796 |
| −0.7866 | 0.9873 | −3.2796 | −2.9692 | −3.5039 | −3.2796 | −5.2888 | −5.7222 | −3.2796 |
| −1.4417 | −0.664 | −3.2796 | −2.1329 | −2.1233 | −3.2796 | −4.0174 | −4.7292 | −3.2796 |
| −0.8426 | 0.8358 | −3.2796 | −3.0633 | −3.6351 | −3.2796 | −5.4221 | −5.8134 | −3.2796 |
| −1.506 | −0.8121 | −3.2796 | −2.209 | −2.2658 | −3.2796 | −4.1357 | −4.8391 | −3.2796 |
| −0.8993 | 0.6846 | −3.2796 | −3.1596 | −3.7648 | −3.2796 | −5.5531 | −5.9078 | −3.2796 |
| −1.5713 | −0.9598 | −3.2796 | −2.2866 | −2.4074 | −3.2796 | −4.2565 | −4.9464 | −3.2796 |
| −0.9566 | 0.5336 | −3.2796 | −3.2582 | −3.8927 | −3.2796 | −5.6798 | −6.008 | −3.2796 |
| −1.6375 | −1.1072 | −3.2796 | −2.3658 | −2.5482 | −3.2796 | −4.3796 | −5.051 | −3.2796 |
| −1.0146 | 0.3828 | −3.2796 | −3.3592 | −4.0187 | −3.2796 | −5.7994 | −6.1165 | −3.2796 |
| −1.7047 | −1.254 | −3.2796 | −2.4466 | −2.688 | −3.2796 | −4.5048 | −5.153 | −3.2796 |
| −1.0733 | 0.2324 | −3.2796 | −3.4627 | −4.1427 | −3.2796 | −5.906 | −6.2376 | −3.2796 |
| −1.773 | −1.4004 | −3.2796 | −2.5291 | −2.8269 | −3.2796 | −4.632 | −5.2526 | −3.2796 |
| −1.1327 | 0.0822 | −3.2796 | −3.5687 | −4.2646 | −3.2796 | −4.7608 | −5.35 | −3.2796 |
| −1.8425 | −1.5462 | −3.2796 | −2.6134 | −2.9647 | −3.2796 | −4.8911 | −5.4455 | −3.2796 |
| −1.1928 | −0.0677 | −3.2796 | −3.6772 | −4.3843 | −3.2796 | −6.0421 | −6.5274 | −3.2796 |
| −3.7881 | −4.5017 | −3.2796 | −2.6995 | −3.1014 | −3.2796 | −5.991 | −6.3747 | −3.2796 |
| −1.1163 | 0.1571 | −4.0296 | −3.4096 | −4.0059 | −4.0296 | −3.618 | −4.2463 | −4.0296 |
| −1.7469 | −1.3031 | −4.0296 | −2.4124 | −2.5703 | −4.0296 | −5.9085 | −6.2052 | −4.0296 |
| −1.0582 | 0.3052 | −4.0296 | −3.3088 | −3.8828 | −4.0296 | −6.0418 | −6.491 | −4.0296 |
| −1.6794 | −1.1591 | −4.0296 | −2.3326 | −2.4327 | −4.0296 | −4.5395 | −5.1222 | −4.0296 |
| −1.0009 | 0.4536 | −4.0296 | −3.2102 | −3.758 | −4.0296 | −5.8041 | −6.0853 | −4.0296 |
| −1.613 | −1.0145 | −4.0296 | −2.2544 | −2.2941 | −4.0296 | −4.4171 | −5.0207 | −4.0296 |
| −0.9443 | 0.6023 | −4.0296 | −3.1138 | −3.6315 | −4.0296 | −5.6872 | −5.9775 | −4.0296 |
| −1.5476 | −0.8695 | −4.0296 | −2.1777 | −2.1547 | −4.0296 | −4.2965 | −4.9169 | −4.0296 |
| −0.8886 | 0.7513 | −4.0296 | −3.0194 | −3.5034 | −4.0296 | −5.5633 | −5.8778 | −4.0296 |
| −1.4831 | −0.724 | −4.0296 | −2.1026 | −2.0145 | −4.0296 | −4.178 | −4.8107 | −4.0296 |
| −0.8336 | 0.9006 | −4.0296 | −2.9271 | −3.3738 | −4.0296 | −5.4351 | −5.7835 | −4.0296 |
| −1.4197 | −0.5782 | −4.0296 | −2.0288 | −1.8736 | −4.0296 | −4.0617 | −4.7022 | −4.0296 |
| −0.7791 | 1.05 | −4.0296 | −2.8368 | −3.2429 | −4.0296 | −5.3049 | −5.6921 | −4.0296 |
| −1.3572 | −0.4319 | −4.0296 | −1.9564 | −1.7319 | −4.0296 | −3.9475 | −4.5915 | −4.0296 |
| −1.2957 | −0.2852 | −4.0296 | −2.7483 | −3.1106 | −4.0296 | −5.1745 | −5.601 | −4.0296 |
| −1.235 | −0.1381 | −4.0296 | −2.6617 | −2.9772 | −4.0296 | −5.045 | −5.5086 | −4.0296 |
| −1.8853 | −1.5896 | −4.0296 | −2.5769 | −2.8426 | −4.0296 | −4.9166 | −5.4147 | −4.0296 |
| −1.1752 | 0.0093 | −4.0296 | −3.5127 | −4.1271 | −4.0296 | −4.7895 | −5.3191 | −4.0296 |
| −1.8155 | −1.4467 | −4.0296 | −3.8355 | −4.4785 | −4.0296 | −5.9917 | −6.3405 | −4.0296 |
| −2.4938 | −2.707 | −4.0296 | −3.7256 | −4.3634 | −4.0296 | −4.6637 | −5.2216 | −4.0296 |

TABLE I-continued

| Airfoil pressure-side defining points: | | | | | | | | |
|---|---|---|---|---|---|---|---|---|
| X | Y | Z | X | Y | Z | X | Y | Z |
| −0.9339 | 0.4406 | −4.7796 | −1.7517 | −1.4161 | −4.7796 | −2.2721 | −2.3769 | −4.7796 |
| −0.9912 | 0.2954 | −4.7796 | −1.9665 | −1.8323 | −4.7796 | −1.5476 | −0.9946 | −4.7796 |
| −1.0492 | 0.1504 | −4.7796 | −3.5538 | −4.1426 | −4.7796 | −5.5757 | −5.8527 | −4.7796 |
| −1.108 | 0.0058 | −4.7796 | −2.6023 | −2.9068 | −4.7796 | −4.3359 | −4.9049 | −4.7796 |
| −1.1678 | −0.1384 | −4.7796 | −1.8221 | −1.5555 | −4.7796 | −5.6964 | −5.9517 | −4.7796 |
| −1.2286 | −0.2822 | −4.7796 | −3.6597 | −4.2573 | −4.7796 | −4.4549 | −5.006 | −4.7796 |
| −1.2903 | −0.4256 | −4.7796 | −2.6891 | −3.0366 | −4.7796 | −5.8103 | −6.0584 | −4.7796 |
| −1.3531 | −0.5686 | −4.7796 | −1.8936 | −1.6943 | −4.7796 | −4.5754 | −5.1053 | −4.7796 |
| −0.7673 | 0.8783 | −4.7796 | −3.7677 | −4.3701 | −4.7796 | −5.9119 | −6.1768 | −4.7796 |
| −1.4169 | −0.7111 | −4.7796 | −2.7776 | −3.1652 | −4.7796 | −4.6973 | −5.2028 | −4.7796 |
| −0.8215 | 0.7319 | −4.7796 | −3.8776 | −4.4809 | −4.7796 | −5.9927 | −6.3101 | −4.7796 |
| −0.8772 | 0.586 | −4.7796 | −2.8679 | −3.2925 | −4.7796 | −4.8205 | −5.2987 | −4.7796 |
| −3.2481 | −3.7879 | −4.7796 | −2.0408 | −1.9697 | −4.7796 | −4.9449 | −5.3931 | −4.7796 |
| −2.3522 | −2.5109 | −4.7796 | −3.9894 | −4.5899 | −4.7796 | −5.0703 | −5.4861 | −4.7796 |
| −1.6145 | −1.1357 | −4.7796 | −2.9601 | −3.4185 | −4.7796 | −5.1967 | −5.5777 | −4.7796 |
| −3.3479 | −3.9079 | −4.7796 | −2.1164 | −2.1062 | −4.7796 | −5.3239 | −5.6682 | −4.7796 |
| −2.4339 | −2.6439 | −4.7796 | −3.0542 | −3.5431 | −4.7796 | −4.1031 | −4.6968 | −4.7796 |
| −1.6825 | −1.2762 | −4.7796 | −2.1935 | −2.242 | −4.7796 | −6.0415 | −6.458 | −4.7796 |
| −3.4498 | −4.0261 | −4.7796 | −1.4817 | −0.8531 | −4.7796 | −5.4509 | −5.759 | −4.7796 |
| −2.5173 | −2.7759 | −4.7796 | −3.1501 | −3.6663 | −4.7796 | −4.2187 | −4.8019 | −4.7796 |
| −0.7191 | 0.4945 | −5.5296 | −3.9021 | −4.5066 | −5.5296 | −2.2399 | −2.5093 | −5.5296 |
| −0.6633 | 0.6372 | −5.5296 | −1.919 | −1.987 | −5.5296 | −3.1561 | −3.7364 | −5.5296 |
| −1.2749 | −0.7677 | −5.5296 | −2.7689 | −3.2613 | −5.5296 | −4.1303 | −4.7112 | −5.5296 |
| −1.2091 | −0.6293 | −5.5296 | −3.7904 | −4.4017 | −5.5296 | −5.3413 | −5.6497 | −5.5296 |
| −1.1443 | −0.4904 | −5.5296 | −1.8424 | −1.8543 | −5.5296 | −5.2165 | −5.5607 | −5.5296 |
| −1.0807 | −0.351 | −5.5296 | −2.6765 | −3.139 | −5.5296 | −5.0923 | −5.4709 | −5.5296 |
| −1.018 | −0.2111 | −5.5296 | −3.6803 | −4.2951 | −5.5296 | −4.9688 | −5.3802 | −5.5296 |
| −0.9563 | −0.0708 | −5.5296 | −1.7671 | −1.7208 | −5.5296 | −4.846 | −5.2884 | −5.5296 |
| −0.8956 | 0.0699 | −5.5296 | −2.5858 | −3.0154 | −5.5296 | −5.9937 | −6.284 | −5.5296 |
| −0.836 | 0.2111 | −5.5296 | −3.5719 | −4.1868 | −5.5296 | −4.7241 | −5.1955 | −5.5296 |
| −0.7774 | 0.3527 | −5.5296 | −1.6932 | −1.5866 | −5.5296 | −5.9153 | −6.1526 | −5.5296 |
| −1.4097 | −1.043 | −5.5296 | −2.4969 | −2.8906 | −5.5296 | −6.0412 | −6.4293 | −5.5296 |
| −2.1574 | −2.3802 | −5.5296 | −3.4652 | −4.0767 | −5.5296 | −4.6031 | −5.1015 | −5.5296 |
| −3.0566 | −3.6198 | −5.5296 | −1.6205 | −1.4516 | −5.5296 | −5.8165 | −6.0356 | −5.5296 |
| −1.3417 | −0.9056 | −5.5296 | −2.4096 | −2.7646 | −5.5296 | −4.4831 | −5.0061 | −5.5296 |
| −2.0765 | −2.25 | −5.5296 | −3.3604 | −3.9649 | −5.5296 | −5.7055 | −5.93 | −5.5296 |
| −2.9589 | −3.5018 | −5.5296 | −1.5491 | −1.316 | −5.5296 | −4.3642 | −4.9094 | −5.5296 |
| −4.0155 | −4.6098 | −5.5296 | −2.324 | −2.6375 | −5.5296 | −5.5876 | −5.832 | −5.5296 |
| −1.997 | −2.119 | −5.5296 | −3.2573 | −3.8515 | −5.5296 | −4.2466 | −4.8111 | −5.5296 |
| −2.863 | −3.3822 | −5.5296 | −1.4788 | −1.1798 | −5.5296 | −5.4656 | −5.7393 | −5.5296 |
| −4.2636 | −4.8158 | −6.2796 | −4.6222 | −5.0937 | −6.2796 | −4.9869 | −5.3635 | −6.2796 |
| −5.5968 | −5.8103 | −6.2796 | −5.9179 | −6.1289 | −6.2796 | −5.1092 | −5.4524 | −6.2796 |
| −4.3823 | −4.9095 | −6.2796 | −4.7432 | −5.1843 | −6.2796 | −5.2318 | −5.541 | −6.2796 |
| −5.7126 | −5.9076 | −6.2796 | −5.9943 | −6.2591 | −6.2796 | −5.3545 | −5.6294 | −6.2796 |
| −4.5018 | −5.0021 | −6.2796 | −4.8648 | −5.2742 | −6.2796 | −4.1458 | −4.7209 | −6.2796 |
| −5.8212 | −6.0127 | −6.2796 | −6.0409 | −6.4026 | −6.2796 | −5.4767 | −5.7184 | −6.2796 |

The coordinate values given in Table II below define the preferred nominal profile of the suction sidewall surface 34 of airfoil 28:

TABLE II

| Airfoil suction-side - side defining points: | | | | | | | | |
|---|---|---|---|---|---|---|---|---|
| X | Y | Z | X | Y | Z | X | Y | Z |
| −5.7850 | −7.2620 | −0.2796 | −5.6052 | −7.3979 | −0.2796 | −6.0361 | −6.8957 | −0.2796 |
| −5.9385 | −7.0975 | −0.2796 | | | | | | |
| −6.0366 | −6.8603 | −1.0296 | −2.9732 | −7.4804 | −1.0296 | −0.3324 | 0.6277 | −1.0296 |
| −5.9421 | −7.0582 | −1.0296 | −2.8197 | −7.3224 | −1.0296 | −0.8258 | −1.5206 | −1.0296 |
| −5.7944 | −7.2211 | −1.0296 | −4.8358 | −7.7532 | −1.0296 | −1.3654 | −3.6576 | −1.0296 |
| −5.6202 | −7.3560 | −1.0296 | −2.6829 | −7.1496 | −1.0296 | −0.2838 | 0.8427 | −1.0296 |
| −5.4341 | −7.4740 | −1.0296 | −4.6249 | −7.8173 | −1.0296 | −0.7750 | −1.3061 | −1.0296 |
| −5.2405 | −7.5793 | −1.0296 | −2.5610 | −6.9660 | −1.0296 | −1.3081 | −3.4448 | −1.0296 |
| −5.0411 | −7.6732 | −1.0296 | −4.4094 | −7.8633 | −1.0296 | −0.2366 | 1.0580 | −1.0296 |
| −2.4518 | −6.7746 | −1.0296 | −1.6703 | −4.7167 | −1.0296 | −1.2516 | −3.2317 | −1.0296 |
| −4.1906 | −7.8888 | −1.0296 | −0.5267 | −0.2323 | −1.0296 | −1.8722 | −5.3464 | −1.0296 |
| −2.3528 | −6.5777 | −1.0296 | −1.0337 | −2.3774 | −1.0296 | −0.1945 | 1.2739 | −1.0296 |
| −3.9703 | −7.8916 | −1.0296 | −1.6065 | −4.5057 | −1.0296 | −0.6746 | −0.8768 | −1.0296 |

TABLE II-continued

| Airfoil suction-side - side defining points: | | | | | | | | |
|---|---|---|---|---|---|---|---|---|
| X | Y | Z | X | Y | Z | X | Y | Z |
| −2.2614 | −6.3771 | −1.0296 | −0.4780 | −0.0173 | −1.0296 | −1.1960 | −3.0184 | −1.0296 |
| −3.7513 | −7.8682 | −1.0296 | −0.9809 | −2.1634 | −1.0296 | −1.8030 | −5.1371 | −1.0296 |
| −2.1757 | −6.1740 | −1.0296 | −1.5443 | −4.2942 | −1.0296 | −0.6249 | −0.6621 | −1.0296 |
| −3.5375 | −7.8151 | −1.0296 | −0.4295 | 0.1977 | −1.0296 | −0.7246 | −1.0915 | −1.0296 |
| −2.0948 | −5.9690 | −1.0296 | −0.9287 | −1.9492 | −1.0296 | −1.1412 | −2.8049 | −1.0296 |
| −3.3338 | −7.7316 | −1.0296 | −1.4834 | −4.0824 | −1.0296 | −1.7358 | −4.9272 | −1.0296 |
| −2.0178 | −5.7625 | −1.0296 | −0.3810 | 0.4127 | −1.0296 | −0.5756 | −0.4472 | −1.0296 |
| −3.1448 | −7.6185 | −1.0296 | −0.8770 | −1.7350 | −1.0296 | −1.0871 | −2.5913 | −1.0296 |
| −1.9438 | −5.5549 | −1.0296 | −1.4239 | −3.8702 | −1.0296 | | | |
| −6.0360 | −6.8243 | −1.7796 | −1.0993 | −2.3984 | −1.7796 | −0.8511 | −1.3307 | −1.7796 |
| −5.9417 | −7.0209 | −1.7796 | −1.6499 | −4.5202 | −1.7796 | −1.3628 | −3.4624 | −1.7796 |
| −5.7957 | −7.1838 | −1.7796 | −2.3749 | −6.5871 | −1.7796 | −1.9759 | −5.5667 | −1.7796 |
| −5.6241 | −7.3201 | −1.7796 | −3.9926 | −7.8767 | −1.7796 | −2.9943 | −7.4824 | −1.7796 |
| −5.4410 | −7.4405 | −1.7796 | −1.0486 | −2.1851 | −1.7796 | −0.8028 | −1.1168 | −1.7796 |
| −5.2506 | −7.5491 | −1.7796 | −1.5900 | −4.3094 | −1.7796 | −1.3085 | −3.2500 | −1.7796 |
| −5.0543 | −7.6468 | −1.7796 | −2.2851 | −6.3871 | −1.7796 | −1.9066 | −5.3587 | −1.7796 |
| −4.6429 | −7.7971 | −1.7796 | −3.7745 | −7.8553 | −1.7796 | −2.8399 | −7.3270 | −1.7796 |
| −4.4291 | −7.8452 | −1.7796 | −0.9985 | −1.9716 | −1.7796 | −0.7549 | −0.9029 | −1.7796 |
| −4.2117 | −7.8724 | −1.7796 | −1.5314 | −4.0981 | −1.7796 | −0.5204 | 0.1679 | −1.7796 |
| −4.8517 | −7.7303 | −1.7796 | −2.2013 | −6.1845 | −1.7796 | −0.4741 | 0.3822 | −1.7796 |
| −1.2551 | −3.0373 | −1.7796 | −3.5612 | −7.8056 | −1.7796 | −0.4275 | 0.5964 | −1.7796 |
| −1.8396 | −5.1500 | −1.7796 | −0.9489 | −1.7581 | −1.7796 | −0.3811 | 0.8107 | −1.7796 |
| −2.7027 | −7.1561 | −1.7796 | −1.4740 | −3.8865 | −1.7796 | −0.3361 | 1.0253 | −1.7796 |
| −1.2025 | −2.8245 | −1.7796 | −2.1225 | −5.9799 | −1.7796 | −0.2957 | 1.2403 | −1.7796 |
| −1.7747 | −4.9406 | −1.7796 | −3.3571 | −7.7262 | −1.7796 | −0.7074 | −0.6889 | −1.7796 |
| −2.5810 | −6.9738 | −1.7796 | −0.8998 | −1.5444 | −1.7796 | −0.6602 | −0.4748 | −1.7796 |
| −1.1506 | −2.6115 | −1.7796 | −1.4179 | −3.6746 | −1.7796 | −0.6133 | −0.2606 | −1.7796 |
| −1.7115 | −4.7306 | −1.7796 | −2.0477 | −5.7739 | −1.7796 | −0.5668 | −0.0464 | −1.7796 |
| −2.4726 | −6.7833 | −1.7796 | −3.1671 | −7.6171 | −1.7796 | | | |
| −5.0716 | −7.6141 | −2.5296 | −2.4121 | −6.5924 | −2.5296 | −0.8840 | −1.1562 | −2.5296 |
| −4.8727 | −7.7020 | −2.5296 | −4.0232 | −7.8604 | −2.5296 | −1.3742 | −3.2752 | −2.5296 |
| −6.0358 | −6.7831 | −2.5296 | −2.3239 | −6.3936 | −2.5296 | −0.8376 | −0.9436 | −2.5296 |
| −5.9427 | −6.9784 | −2.5296 | −3.8067 | −7.8408 | −2.5296 | −1.5905 | −4.1179 | −2.5296 |
| −5.7987 | −7.1409 | −2.5296 | −2.2418 | −6.1922 | −2.5296 | −1.0255 | −1.7932 | −2.5296 |
| −5.6299 | −7.2779 | −2.5296 | −3.5946 | −7.7932 | −2.5296 | −0.7917 | −0.7310 | −2.5296 |
| −5.4502 | −7.4003 | −2.5296 | −2.1649 | −5.9887 | −2.5296 | −1.2713 | −2.8526 | −2.5296 |
| −5.2637 | −7.5123 | −2.5296 | −3.3913 | −7.7164 | −2.5296 | −1.3224 | −3.0640 | −2.5296 |
| −2.0222 | −5.5778 | −2.5296 | −2.0921 | −5.7838 | −2.5296 | −0.7461 | −0.5183 | −2.5296 |
| −3.0288 | −7.4786 | −2.5296 | −1.9549 | −5.3710 | −2.5296 | −1.7056 | −4.5374 | −2.5296 |
| −2.8742 | −7.3258 | −2.5296 | −3.2017 | −7.6103 | −2.5296 | −0.9779 | −1.5809 | −2.5296 |
| −1.8898 | −5.1634 | −2.5296 | −0.4342 | 0.9719 | −2.5296 | −1.1221 | −2.2173 | −2.5296 |
| −2.7372 | −7.1570 | −2.5296 | −0.3953 | 1.1855 | −2.5296 | −1.6474 | −4.3279 | −2.5296 |
| −4.6671 | −7.7727 | −2.5296 | −0.7009 | −0.3056 | −2.5296 | −1.2209 | −2.6410 | −2.5296 |
| −2.6160 | −6.9764 | −2.5296 | −0.6561 | −0.0928 | −2.5296 | −1.0735 | −2.0053 | −2.5296 |
| −4.4558 | −7.8242 | −2.5296 | −0.6114 | 0.1201 | −2.5296 | −1.5349 | −3.9077 | −2.5296 |
| −1.8267 | −4.9553 | −2.5296 | −0.5668 | 0.3330 | −2.5296 | −1.1712 | −2.4292 | −2.5296 |
| −1.7654 | −4.7466 | −2.5296 | −0.5220 | 0.5459 | −2.5296 | −1.4803 | −3.6971 | −2.5296 |
| −2.5085 | −6.7874 | −2.5296 | −0.4773 | 0.7587 | −2.5296 | −0.9307 | −1.3686 | −2.5296 |
| −4.2405 | −7.8542 | −2.5296 | −1.4268 | −3.4863 | −2.5296 | | | |
| −4.8977 | −7.6714 | −3.2796 | −0.7309 | −0.1575 | −3.2796 | −2.3725 | −6.3970 | −3.2796 |
| −6.0358 | −6.7410 | −3.2796 | −0.6871 | 0.0533 | −3.2796 | −1.1408 | −2.0514 | −3.2796 |
| −5.9443 | −6.9347 | −3.2796 | −0.6433 | 0.2641 | −3.2796 | −1.6495 | −4.1434 | −3.2796 |
| −5.8029 | −7.0964 | −3.2796 | −0.5995 | 0.4749 | −3.2796 | −2.2914 | −6.1975 | −3.2796 |
| −5.6373 | −7.2339 | −3.2796 | −0.5557 | 0.6857 | −3.2796 | −1.0936 | −1.8413 | −3.2796 |
| −5.4615 | −7.3582 | −3.2796 | −0.9091 | −1.0001 | −3.2796 | −1.5947 | −3.9352 | −3.2796 |
| −5.2795 | −7.4732 | −3.2796 | −1.3855 | −3.0998 | −3.2796 | −2.2155 | −5.9960 | −3.2796 |
| −5.0921 | −7.5791 | −3.2796 | −1.9444 | −5.1787 | −3.2796 | −1.0468 | −1.6312 | −3.2796 |
| −4.6959 | −7.7464 | −3.2796 | −2.7834 | −7.1516 | −3.2796 | −1.5410 | −3.7267 | −3.2796 |
| −4.4879 | −7.8016 | −3.2796 | −1.3352 | −2.8904 | −3.2796 | −2.1437 | −5.7931 | −3.2796 |
| −4.2752 | −7.8344 | −3.2796 | −1.8823 | −4.9725 | −3.2796 | −3.2459 | −7.5974 | −3.2796 |
| −3.6358 | −7.7767 | −3.2796 | −2.6627 | −6.9733 | −3.2796 | −1.0005 | −1.4209 | −3.2796 |
| −3.8458 | −7.8232 | −3.2796 | −1.2857 | −2.6809 | −3.2796 | −1.4883 | −3.5179 | −3.2796 |
| −3.4343 | −7.7014 | −3.2796 | −1.8218 | −4.7659 | −3.2796 | −2.0749 | −5.5891 | −3.2796 |
| −4.0602 | −7.8420 | −3.2796 | −2.5558 | −6.7865 | −3.2796 | −0.9546 | −1.2105 | −3.2796 |
| −0.8640 | −0.7896 | −3.2796 | −1.2368 | −2.4712 | −3.2796 | −1.4365 | −3.3089 | −3.2796 |
| −0.8192 | −0.5790 | −3.2796 | −1.7629 | −4.5588 | −3.2796 | −3.0740 | −7.4682 | −3.2796 |
| −0.5135 | 0.8969 | −3.2796 | −2.4600 | −6.5937 | −3.2796 | −2.0085 | −5.3842 | −3.2796 |
| −0.7749 | −0.3683 | −3.2796 | −1.1885 | −2.2614 | −3.2796 | −2.9200 | −7.3179 | −3.2796 |
| −0.4754 | 1.1084 | −3.2796 | −1.7055 | −4.3513 | −3.2796 | | | |
| −6.0357 | −6.7021 | −4.0296 | −1.3865 | −2.9303 | −4.0296 | −1.5934 | −3.7560 | −4.0296 |
| −5.9459 | −6.8938 | −4.0296 | −1.9354 | −4.9861 | −4.0296 | −2.1970 | −5.7961 | −4.0296 |
| −5.8073 | −7.0548 | −4.0296 | −2.7170 | −6.9594 | −4.0296 | −3.2967 | −7.5737 | −4.0296 |

TABLE II-continued

| Airfoil suction-side - side defining points: | | | | | | | | |
|---|---|---|---|---|---|---|---|---|
| X | Y | Z | X | Y | Z | X | Y | Z |
| −5.6454 | −7.1928 | −4.0296 | −1.3367 | −2.7234 | −4.0296 | −0.6064 | 0.6021 | −4.0296 |
| −5.4739 | −7.3187 | −4.0296 | −1.8749 | −4.7821 | −4.0296 | −0.5647 | 0.8107 | −4.0296 |
| −5.2965 | −7.4362 | −4.0296 | −2.6098 | −6.7756 | −4.0296 | −0.5272 | 1.0198 | −4.0296 |
| −5.1140 | −7.5456 | −4.0296 | −1.2875 | −2.5164 | −4.0296 | −0.9582 | −1.0636 | −4.0296 |
| −4.9243 | −7.6420 | −4.0296 | −1.8160 | −4.5776 | −4.0296 | −0.9130 | −0.8557 | −4.0296 |
| −4.7269 | −7.7212 | −4.0296 | −2.5137 | −6.5857 | −4.0296 | −0.8683 | −0.6476 | −4.0296 |
| −4.5223 | −7.7794 | −4.0296 | −4.0999 | −7.8210 | −4.0296 | −0.8240 | −0.4395 | −4.0296 |
| −4.3124 | −7.8134 | −4.0296 | −1.2389 | −2.3092 | −4.0296 | −0.6497 | 0.3937 | −4.0296 |
| −1.5405 | −3.5499 | −4.0296 | −1.7585 | −4.3727 | −4.0296 | −0.7801 | −0.2312 | −4.0296 |
| −2.1282 | −5.5947 | −4.0296 | −2.4260 | −6.3919 | −4.0296 | −0.7366 | −0.0229 | −4.0296 |
| −3.1267 | −7.4459 | −4.0296 | −3.8881 | −7.8011 | −4.0296 | −0.6931 | 0.1854 | −4.0296 |
| −1.4884 | −3.3436 | −4.0296 | −1.7023 | −4.1675 | −4.0296 | −1.0498 | −1.4793 | −4.0296 |
| −2.0618 | −5.3925 | −4.0296 | −2.3447 | −6.1952 | −4.0296 | −1.0038 | −1.2715 | −4.0296 |
| −2.9738 | −7.2980 | −4.0296 | −3.6809 | −7.7533 | −4.0296 | −1.1908 | −2.1019 | −4.0296 |
| −1.4371 | −3.1370 | −4.0296 | −1.6473 | −3.9619 | −4.0296 | −1.1433 | −1.8945 | −4.0296 |
| −1.9977 | −5.1896 | −4.0296 | −2.2688 | −5.9964 | −4.0296 | −1.0963 | −1.6869 | −4.0296 |
| −2.8376 | −7.1346 | −4.0296 | −3.4823 | −7.6773 | −4.0296 | | | |
| −5.6579 | −7.1522 | −4.7796 | −2.5766 | −6.5945 | −4.7796 | −2.2517 | −5.8242 | −4.7796 |
| −5.4912 | −7.2784 | −4.7796 | −4.1509 | −7.7964 | −4.7796 | −1.0538 | −1.6016 | −4.7796 |
| −5.3189 | −7.3969 | −4.7796 | −2.4869 | −6.4056 | −4.7796 | −1.5695 | −3.6281 | −4.7796 |
| −6.0361 | −6.6654 | −4.7796 | −3.9427 | −7.7776 | −4.7796 | −2.1808 | −5.6275 | −4.7796 |
| −5.9494 | −6.8546 | −4.7796 | −2.4036 | −6.2138 | −4.7796 | −1.0054 | −1.3982 | −4.7796 |
| −5.8151 | −7.0144 | −4.7796 | −0.6805 | 0.0291 | −4.7796 | −1.5149 | −3.4262 | −4.7796 |
| −5.1416 | −7.5077 | −4.7796 | −0.6354 | 0.2333 | −4.7796 | −2.1123 | −5.4299 | −4.7796 |
| −4.9573 | −7.6064 | −4.7796 | −0.5905 | 0.4376 | −4.7796 | −1.4611 | −3.2242 | −4.7796 |
| −4.7651 | −7.6886 | −4.7796 | −0.5472 | 0.6422 | −4.7796 | −2.0459 | −5.2316 | −4.7796 |
| −4.5653 | −7.7500 | −4.7796 | −0.5053 | 0.8469 | −4.7796 | −1.4080 | −3.0219 | −4.7796 |
| −4.3596 | −7.7869 | −4.7796 | −0.9575 | −1.1946 | −4.7796 | −1.9814 | −5.0327 | −4.7796 |
| −3.7391 | −7.7308 | −4.7796 | −0.9102 | −0.9909 | −4.7796 | −1.3555 | −2.8195 | −4.7796 |
| −2.3256 | −6.0198 | −4.7796 | −0.8633 | −0.7871 | −4.7796 | −1.9186 | −4.8332 | −4.7796 |
| −3.5440 | −7.6560 | −4.7796 | −0.8169 | −0.5832 | −4.7796 | −1.3038 | −2.6169 | −4.7796 |
| −3.3616 | −7.5541 | −4.7796 | −0.7711 | −0.3792 | −4.7796 | −1.8573 | −4.6333 | −4.7796 |
| −3.1941 | −7.4291 | −4.7796 | −0.7256 | −0.1751 | −4.7796 | −1.2527 | −2.4141 | −4.7796 |
| −3.0420 | −7.2858 | −4.7796 | −1.1522 | −2.0081 | −4.7796 | −1.7974 | −4.4329 | −4.7796 |
| −2.9053 | −7.1276 | −4.7796 | −1.6813 | −4.0311 | −4.7796 | −1.2022 | −2.2112 | −4.7796 |
| −2.7834 | −6.9578 | −4.7796 | −1.1027 | −1.8049 | −4.7796 | −1.7388 | −4.2322 | −4.7796 |
| −2.6746 | −6.7792 | −4.7796 | −1.6249 | −3.8297 | −4.7796 | | | |
| −5.9546 | −6.8190 | −5.5296 | −4.0007 | −7.7535 | −5.5296 | −3.1134 | −7.2812 | −5.5296 |
| −5.8254 | −6.9775 | −5.5296 | −1.1520 | −2.3703 | −5.5296 | −0.8812 | −1.3828 | −5.5296 |
| −5.6732 | −7.1143 | −5.5296 | −1.7439 | −4.3307 | −5.5296 | −1.4385 | −3.3533 | −5.5296 |
| −5.5111 | −7.2395 | −5.5296 | −2.4592 | −6.2485 | −5.5296 | −2.0775 | −5.2987 | −5.5296 |
| −5.3433 | −7.3567 | −5.5296 | −3.8008 | −7.7100 | −5.5296 | −2.9767 | −7.1288 | −5.5296 |
| −6.0369 | −6.6326 | −5.5296 | −1.0967 | −2.1731 | −5.5296 | −0.8289 | −1.1848 | −5.5296 |
| −4.2049 | −7.7679 | −5.5296 | −1.6809 | −4.1358 | −5.5296 | −1.3798 | −3.1571 | −5.5296 |
| −0.6755 | −0.5899 | −5.5296 | −2.3767 | −6.0611 | −5.5296 | −2.0079 | −5.1061 | −5.5296 |
| −0.6255 | −0.3913 | −5.5296 | −3.6092 | −7.6383 | −5.5296 | −2.8534 | −6.9654 | −5.5296 |
| −4.8038 | −7.6480 | −5.5296 | −1.0419 | −1.9758 | −5.5296 | −1.3218 | −2.9607 | −5.5296 |
| −0.5760 | −0.1926 | −5.5296 | −1.6190 | −3.9406 | −5.5296 | −1.9399 | −4.9129 | −5.5296 |
| −5.1704 | −7.4666 | −5.5296 | −2.2981 | −5.8720 | −5.5296 | −2.7420 | −6.7936 | −5.5296 |
| −4.9909 | −7.5649 | −5.5296 | −3.4297 | −7.5401 | −5.5296 | −1.2646 | −2.7641 | −5.5296 |
| −4.6094 | −7.7123 | −5.5296 | −0.9878 | −1.7783 | −5.5296 | −1.8732 | −4.7193 | −5.5296 |
| −0.7771 | −0.9867 | −5.5296 | −1.5580 | −3.7451 | −5.5296 | −2.6405 | −6.6158 | −5.5296 |
| −4.4090 | −7.7535 | −5.5296 | −2.2224 | −5.6818 | −5.5296 | −0.5268 | 0.0062 | −5.5296 |
| −0.7260 | −0.7884 | −5.5296 | −3.2643 | −7.4196 | −5.5296 | −0.4781 | 0.2051 | −5.5296 |
| −1.2080 | −2.5673 | −5.5296 | −0.9342 | −1.5806 | −5.5296 | −0.4308 | 0.4043 | −5.5296 |
| −1.8079 | −4.5252 | −5.5296 | −1.4979 | −3.5493 | −5.5296 | −0.3875 | 0.6041 | −5.5296 |
| −2.5468 | −6.4337 | −5.5296 | −2.1489 | −5.4906 | −5.5296 | | | |
| −6.0381 | −6.6009 | −6.2796 | −4.6588 | −7.6681 | −6.2796 | −2.5220 | −6.2985 | −6.2796 |
| −5.9614 | −6.7842 | −6.2796 | −4.4646 | −7.7139 | −6.2796 | −3.8707 | −7.6910 | −6.2796 |
| −5.8385 | −6.9411 | −6.2796 | −5.0281 | −7.5177 | −6.2796 | −2.4332 | −6.1197 | −6.2796 |
| −5.6921 | −7.0767 | −6.2796 | −4.0668 | −7.7277 | −6.2796 | −3.6825 | −7.6251 | −6.2796 |
| −5.5349 | −7.1997 | −6.2796 | −3.0580 | −7.1379 | −6.2796 | −2.3476 | −5.9393 | −6.2796 |
| −5.3713 | −7.3142 | −6.2796 | −2.9336 | −6.9819 | −6.2796 | −3.5061 | −7.5318 | −6.2796 |
| −5.2027 | −7.4210 | −6.2796 | −2.8195 | −6.8180 | −6.2796 | −2.2644 | −5.7578 | −6.2796 |
| −4.8468 | −7.6013 | −6.2796 | −2.7140 | −6.6485 | −6.2796 | −3.3434 | −7.4164 | −6.2796 |
| −4.2661 | −7.7347 | −6.2796 | −2.6153 | −6.4750 | −6.2796 | −3.1943 | −7.2838 | −6.2796 |

The coordinate values given in Table III below define the preferred nominal profile of the outer sidewall flowpath surface 44:

TABLE III

Outer side-wall flow-path surface defining points:

| X | Y | Z | X | Y | Z | X | Y | Z |
|---|---|---|---|---|---|---|---|---|
| −8.0462 | −11.765 | 0.3324 | −5.7235 | −9.716 | 0.1329 | −0.975 | −4.954 | −0.2198 |
| −7.8801 | −4.6266 | 1.3399 | −5.7009 | −5.273 | 0.7186 | −0.9486 | −6.1158 | −0.3357 |
| −7.8801 | −9.5936 | 0.719 | −5.4976 | −2.8623 | 0.8383 | −0.4908 | 1.794 | −0.0288 |
| −7.3261 | −6.3264 | 1.0395 | −4.6571 | −8.9505 | −0.0229 | −0.4589 | −3.6223 | −0.1176 |
| −7.3261 | −7.7626 | 0.8614 | −4.4868 | −1.2181 | 0.6322 | −0.4095 | −2.1344 | 0.1479 |
| −7.1859 | −3.1945 | 1.2641 | −4.4413 | −2.1423 | 0.5927 | 0 | 0 | 0 |
| −7.1017 | −10.6237 | 0.3358 | −4.0908 | −3.6915 | 0.4205 | 0.5314 | −0.7226 | −0.0047 |
| −6.9743 | −8.0963 | 0.7215 | −3.3976 | −1.4307 | 0.3414 | 0.5357 | −2.2551 | −0.0455 |
| −6.5097 | −6.9494 | 0.751 | −3.2414 | −0.3817 | 0.3173 | 0.5615 | 0.4658 | −0.0019 |
| −6.5033 | −3.5483 | 1.0638 | −2.575 | −2.2685 | 0.1161 | 0.586 | −3.7338 | −0.1249 |
| −6.3779 | −9.2785 | 0.3811 | −2.4905 | −7.989 | −0.4268 | 0.6749 | 2.1874 | −0.0429 |
| −5.8882 | −8.2905 | 0.4054 | −2.3598 | −0.7454 | 0.1178 | 0.7165 | −5.2607 | −0.2483 |
| −5.7291 | −2.0598 | 0.9339 | −1.9313 | 0.4199 | 0.0595 | | | |

The coordinate values given in Table IV below define the preferred nominal profile of the inner sidewall flowpath surface 46:

TABLE IV

Inner side-wall flow-path surface defining points:

| X | Y | Z | X | Y | Z | X | Y | Z |
|---|---|---|---|---|---|---|---|---|
| −8.228 | −7.6193 | −7.6955 | −5.941 | −2.9178 | −6.9572 | −2.2147 | −7.0004 | −7.0008 |
| −8.2169 | −4.0929 | −7.2665 | −5.8658 | −9.1232 | −7.7194 | −1.4346 | 0.1528 | −6.4958 |
| −8.1813 | −10.0627 | −8.1389 | −5.8449 | −5.2634 | −7.1437 | −1.4062 | −5.5283 | −6.8062 |
| −7.5734 | −4.5743 | −7.2566 | −5.5114 | −3.4896 | −6.9495 | −0.8074 | −4.4558 | −6.6971 |
| −7.5055 | −9.0975 | −7.8899 | −5.4679 | −7.9184 | −7.4642 | −0.6355 | 1.0363 | −6.5065 |
| −7.4059 | −5.6132 | −7.3479 | −4.7804 | −8.4017 | −7.4724 | −0.5207 | −5.4003 | −6.7919 |
| −7.2399 | −7.8958 | −7.6492 | −4.6016 | −1.9885 | −6.7697 | −0.0601 | 1.229 | −6.5109 |
| −7.0845 | −3.2011 | −7.0954 | −4.5359 | −2.8137 | −6.8032 | −0.0205 | −1.884 | −6.5316 |
| −7.0845 | −6.8541 | −7.4736 | −4.5139 | −4.3753 | −6.9155 | −0.0062 | −3.6659 | −6.6319 |
| −7.0845 | −10.4684 | −8.125 | −3.5604 | −2.1379 | −6.6665 | 1.004 | −0.6522 | −6.4999 |
| −6.9885 | −5.3464 | −7.2737 | −3.4228 | −7.974 | −7.2555 | 1.004 | 0.7912 | −6.5019 |
| −6.451 | −6.4312 | −7.3484 | −3.347 | −3.4773 | −6.7205 | 1.004 | 1.7598 | −6.527 |
| −6.4326 | −4.1273 | −7.0963 | −3.2639 | −1.0502 | −6.6001 | 1.004 | −1.8437 | −6.53 |
| −6.4016 | −8.6054 | −7.6813 | −2.6314 | −1.5019 | −6.5485 | 1.004 | −3.0334 | −6.5889 |
| −6.3553 | −7.4736 | −7.4878 | −2.524 | −0.3968 | −6.5193 | 1.004 | −4.2193 | −6.6763 |

It will also be appreciated that the flowpath surfaces disclosed in the above Tables may be scaled up or down geometrically for use in similar turbine designs. Consequently, the coordinate values set forth in Tables I–IV may be scaled upwardly or downwardly such that the flowpath surface contours remain unchanged. A scaled version of the coordinates in Tables I–IV would be represented by X, Y and Z coordinate values multiplied or divided by the same constant or number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine nozzle having a pressure side airfoil surface, said pressure side airfoil surface having a nominal profile substantially in accordance with Cartesian coordinate values of X, Y and Z set forth in inches in Table I, wherein the Z values are drop dimensions from a reference point origin on an outside diameter flowpath along a nozzle airfoil stacking axis perpendicular to a centerline axis of rotation of the turbine; and wherein the X and Y values, when connected by smooth continuing arcs, define pressure side airfoil surface profile sections at each distance Z from said origin, the profile sections at the Z distances being joined smoothly with one another to form a pressure side airfoil surface shape.

2. A turbine nozzle according to claim 1, forming part of a first stage of a turbine.

3. A turbine nozzle according to claim 1, wherein said pressure side airfoil surface lies in an envelope within ±0.105 inches in a direction normal to any pressure side airfoil surface location.

4. A turbine nozzle according to claim 3, wherein said pressure side airfoil surface is coated, the X, Y and Z distances being scalable as a function of the same constant or number to provide a scaled up or scaled down pressure side airfoil surface shape.

5. A turbine nozzle according to claim 1, having an outer sidewall surface, said outer sidewall surface having a nominal profile substantially in accordance with Cartesian coordinate values of X, Y and Z set forth in inches in Table III, wherein the Z values in Table III are drop dimensions from said reference point origin on said outside diameter flowpath along said nozzle airfoil stacking axis perpendicular to said centerline axis of rotation of the turbine; and wherein the X and Y values in Table III, when connected by smooth continuing arcs at each distance Z in Table III, define an outer sidewall surface shape.

6. A turbine nozzle according to claim 1, having an inner sidewall surface, said inner sidewall surface having a nominal profile substantially in accordance with Cartesian coordinate values of X, Y and Z set forth in inches in Table IV, wherein the Z values in Table IV are drop dimensions from said reference point origin on said outside diameter flowpath along said nozzle airfoil stacking axis perpendicular to said centerline axis of rotation of the turbine; and wherein the X and Y values in Table IV, when connected by smooth continuing arcs at each distance Z in Table IV, define an inner sidewall surface shape.

7. A turbine nozzle according to claim 1, having a suction side airfoil, said suction side airfoil surface having a nominal profile substantially in accordance with Cartesian coordinate values of X, Y and Z set forth in inches in Table II, wherein the Z values in Table II are drop dimensions from said reference point origin on said outside diameter flowpath along said nozzle airfoil stacking axis perpendicular to said centerline axis of rotation of the turbine; and wherein the X and Y values in Table II, when connected by smooth continuing arcs, define suction side airfoil surface profile sections at each distance Z in Table II from said origin, the profile sections at the Z distances in Table II being joined smoothly with one another to form a suction side airfoil surface shape.

8. A turbine nozzle having a suction side airfoil surface, said suction side airfoil surface having a nominal profile substantially in accordance with Cartesian coordinate values of X, Y and Z set forth in inches in Table II, wherein the Z values are drop dimensions from a reference point origin on an outside diameter flowpath along a nozzle airfoil stacking axis perpendicular to a centerline axis of rotation of the turbine; and wherein the X and Y values, when connected by smooth continuing arcs, define suction side airfoil surface profile sections at each distance Z from said origin, the profile sections at the Z distances being joined smoothly with one another to form a suction side airfoil surface shape.

9. A turbine nozzle according to claim 8, forming part of a first stage of a turbine.

10. A turbine nozzle according to claim 8, wherein said suction side airfoil surface lies in an envelope within ±0.105 inches in a direction normal to any suction side airfoil surface location.

11. A turbine nozzle according to claim 10, wherein said suction side airfoil surface is coated, the X, Y and Z distances being scalable as a function of the same constant or number to provide a scaled up or scaled down suction side airfoil surface shape.

12. A turbine nozzle according to claim 8, having an outer sidewall surface, said outer sidewall surface having a nominal profile substantially in accordance with Cartesian coordinate values of X, Y and Z set forth in inches in Table III, wherein the Z values in Table III are drop dimensions from said reference point origin on said outside diameter flowpath along said nozzle airfoil stacking axis perpendicular to said centerline axis of rotation of the turbine; and wherein the X and Y values in Table III, when connected by smooth continuing arcs at each distance Z in Table III, define an outer sidewall surface shape.

13. A turbine nozzle according to claim 8, having an inner sidewall surface, said inner sidewall surface having a nominal profile substantially in accordance with Cartesian coordinate values of X, Y and Z set forth in inches in Table IV, wherein the Z values in Table IV are drop dimensions from said reference point origin on said outside diameter flowpath along said nozzle airfoil stacking axis perpendicular to said centerline axis of rotation of the turbine; and wherein the X and Y values in Table IV, when connected by smooth continuing arcs at each distance Z in Table IV, define an inner sidewall surface shape.

14. A turbine nozzle having an outer sidewall surface, said outer sidewall surface having a nominal profile substantially in accordance with Cartesian coordinate values of X, Y and Z set forth in inches in Table III, wherein the Z values are drop dimensions from a reference point origin on an outside diameter flowpath along a nozzle airfoil stacking axis perpendicular to a centerline axis of rotation of the turbine; and wherein the X and Y values, when connected by, smooth continuing arcs at each distance Z, define an outer sidewall surface shape.

15. A turbine nozzle according to claim 14, forming part of a first stage of a turbine.

16. A turbine nozzle according to claim 14, wherein said outer sidewall surface lies in an envelope within ±0.105 inches in a direction normal to any outer sidewall surface location.

17. A turbine nozzle according to claim 16, wherein said outer sidewall surface is coated, the X, Y and Z distances being scalable as a function of the same constant or number to provide a scaled up or scaled down outer sidewall surface shape.

18. The turbine nozzle of claim 14 having an inner sidewall, said inner sidewall surface having a nominal profile substantially in accordance with Cartesian coordinate values of X, Y and Z set forth in inches in Table IV, wherein the Z values in Table IV are drop dimensions from said reference point origin on said outside diameter flowpath along said nozzle airfoil stacking axis perpendicular to said centerline axis of rotation of the turbine; and wherein the X and Y values in Table IV, when connected by smooth continuing arcs at each distance Z in Table IV, define an inner sidewall surface shape.

19. A turbine nozzle having an inner sidewall surface, said inner sidewall surface having a nominal profile substantially in accordance with Cartesian coordinate values of X, Y and Z set forth in inches in Table IV, wherein the Z values are drop dimensions from a reference point origin on an outside diameter flowpath along a nozzle airfoil stacking axis perpendicular to a centerline axis of rotation of the turbine; and wherein the X and Y values, when connected by smooth continuing arcs at each distance Z, define an inner sidewall surface shape.

20. A turbine nozzle according to claim 19, forming part of a first stage of a turbine.

21. A turbine nozzle according to claim 19, wherein said inner sidewall surface lies in an envelope within ±0.105 inches in a direction normal to any inner sidewall surface location.

22. A turbine nozzle according to claim 21, wherein said inner sidewall surface is coated, the X, Y and Z distances being scalable as a function of the same constant or number to provide a scaled up or scaled down inner sidewall surface shape.

23. A turbine comprising a turbine nozzle having a plurality of airfoils having an airfoil shape, each said airfoil having pressure and suction side airfoil surfaces defining a nominal airfoil profile substantially in accordance with Cartesian coordinate values of X, Y and Z set forth in Tables I and II, wherein the Z values are drop dimensions from a reference point origin on an outside diameter flowpath along a nozzle airfoil stacking axis perpendicular to a centerline axis of rotation of the turbine, and wherein the X and Y values, when connected by smooth continuing arcs, define airfoil profile sections at each distance Z, the profile sections at the Z distances being joined smoothly with one another to form an airfoil shape.

24. The turbine according to claim 23 including an inner sidewall, said inner sidewall surface having a nominal profile substantially in accordance with Cartesian coordinate values of X, Y and Z set forth in inches in Table IV, wherein the values Z in Table IV are drop dimensions from said reference point origin on said outside diameter flowpath along said nozzle airfoil stacking axis perpendicular to said centerline axis of rotation of the turbine; and wherein the X and Y values in Table IV, when connected by smooth continuing arcs at each distance Z in Table IV, define an inner sidewall surface shape.

25. The turbine according to claim 23, including an outer sidewall, said outer sidewall surface having a nominal profile substantially in accordance with Cartesian coordinate values of X, Y and Z set forth in inches in Table III, wherein the Z values in Table III are drop dimensions from said reference point origin on said outside diameter flowpath along said nozzle airfoil stacking axis perpendicular to said centerline axis of rotation of the turbine; and wherein the X and Y values in Table III, when connected by smooth continuing arcs at each distance Z in Table III, define an outer sidewall surface shape.

26. The turbine according to claim 25, including an inner sidewall, said inner sidewall surface having a nominal profile substantially in accordance with Cartesian coordinate values of X, Y and Z set forth in inches in Table IV, wherein the Z values in Table IV are drop dimensions from said reference point origin on said outside diameter flowpath along said nozzle airfoil stacking axis perpendicular to said centerline axis of rotation of the turbine; and wherein the X and Y values in Table IV, when connected by smooth continuing arcs at each distance Z in Table IV, define an inner sidewall surface shape.

* * * * *